US005351447A

United States Patent [19]

Grauert

[11] Patent Number: 5,351,447

[45] Date of Patent: Oct. 4, 1994

[54] INFLATABLE SANDING DRUM

[76] Inventor: Robert J. Grauert, 24 Spruce St., Shillington, Pa. 19607

[21] Appl. No.: 2,051

[22] Filed: Jan. 8, 1993

[51] Int. Cl.[5] ..... B24D 9/02

[52] U.S. Cl. ..... 451/505; 51/363; 51/381

[58] Field of Search ..... 51/373, 372, 358, 170 EB, 51/363, 381

[56] References Cited

U.S. PATENT DOCUMENTS

| | | | |
|---|---|---|---|
| 1,444,312 | 2/1923 | Herder . | |
| 2,131,449 | 9/1938 | Mary | 51/373 |
| 2,225,073 | 12/1940 | Miller | 51/373 |
| 2,353,646 | 7/1944 | Cantley | 51/373 |
| 2,490,472 | 12/1949 | Raske . | |
| 2,601,048 | 6/1952 | Monger . | |
| 2,870,582 | 1/1959 | Raske . | |
| 3,203,073 | 8/1965 | Stein . | |
| 3,221,449 | 12/1965 | Lewis et al. | 51/373 |
| 3,319,686 | 5/1967 | Prevette | 51/373 |
| 3,496,685 | 2/1970 | Schmidt et al. . | |
| 4,897,968 | 2/1990 | Hutt . | |

FOREIGN PATENT DOCUMENTS

| | | | |
|---|---|---|---|
| 0143878 | 10/1951 | Australia | 51/373 |

*Primary Examiner*—Robert A. Rose

*Attorney, Agent, or Firm*—Richard C. Litman

[57] ABSTRACT

An inflatable sanding drum used for a drill or a lathe to said a wood has a cover between an abrasive member and a rubber bladder which defines an air chamber of the roller. Thus, even if the abrasive member is worn out by the friction with the wood surface, the rubber bladder is protected from damage. When the cover is damaged, it may be replaced with a new cover thus reducing the risk of damage to the rubber bladder.

7 Claims, 2 Drawing Sheets

INFLATABLE SANDING DRUM

BACKGROUND OF THE INVENTION

1. FIELD OF THE INVENTION

The present invention relates generally to abrading machines, and more particularly to a tool support for flexible-member tools. The present invention especially suitable for attachment to a drill, a lathe or the like via a chuck or threadable attachment.

2. DESCRIPTION OF THE PRIOR ART

An inflatable sanding drum is generally used to sand a wood surface, and includes a connection member, an abrasive member, and air-chamber forming means. The connection member is connectable to a rotatable element such as is found on a drill, a lathe or the like. The abrasive member encloses the connection member and facilitates in sanding the wood surface when being rotated with the connection member by the drill. The air-chamber forming means forms an inflatable air chamber between the connection member and the abrasive member. The abrasive member is attached over a rubber surface defining the air chamber. A contact condition between the abrasive surface and the wood surface can be changed by adjusting air pressure of the air chamber. Such inflatable sanding drums are shown in U.S. Pat. No. 1,444,314 issued Feb. 6, 1923 to Herder, U.S. Pat. No. 2,490,472 issued Dec. 6, 1949 to Raske, U.S. Pat. No. 2,601,048 issued Jun. 17, 1952 to Monger, U.S. Pat. No. 2,870,582 issued Jan. 27, 1959 to Raske, U.S. Pat. No. 3,496,685 issued Feb. 24, 1970 to Schmidt et al., and U.S. Pat. No. 4,897,968 issued Feb. 6, 1990 to Hutt.

However, all the above rollers have a disadvantage in that as the abrasive surface is getting worn away, the rubber surface becomes damaged by the contact with the wood surface.

Another patent which may be deemed of interest is U.S. Pat. No. 3,203,073 issued Aug. 31, 1965 to Stein which discloses a top roll for drafting devices on textile machines which is entirely remote from applicant's instant invention.

SUMMARY OF THE INVENTION

The present invention relates to a tool support for flexible-member tools for use with apparatuses, such as drills, lathes, or the like, having rotatable elements. A device according to the present invention is used for abrading a predetermined surface area and comprises a connection member, an air-chamber forming member, a cover member, and an abrasive member. The connection member is connectable to the abrading machine so as to be rotated therewith. The air-chamber forming member is coupled to the connection member, and forms an air chamber around said connection member. The air-chamber forming member includes a chamber wall which defines the air chamber. The cover member is attached to the chamber wall of the air-chamber forming member so as to cover the chamber wall. The abrasive member is attached to the cover member and is rotatable with the connection member so as to abrade the predetermined surface area.

According to one feature of the present invention, the cover member protects the chamber wall from being damaged through contact with the predetermined surface area. The cover, if damaged, is replaceable with a new cover so as to prevent the chamber wall from being damaged.

Accordingly, it is a general object of the invention to provide a novel and useful inflatable sanding drum in which the above disadvantage is eliminated.

It is another object of the invention to provide an inflatable sanding drum in which an air chamber is effectively protected even if the abrasive surface is worn away.

Other objects and further features of the present invention will become apparent from the following detailed description when read in conjunction with the accompanying drawings.

DETAILED DESCRIPTION OF THE PREFERRED EMBODIMENT

Figure 1:
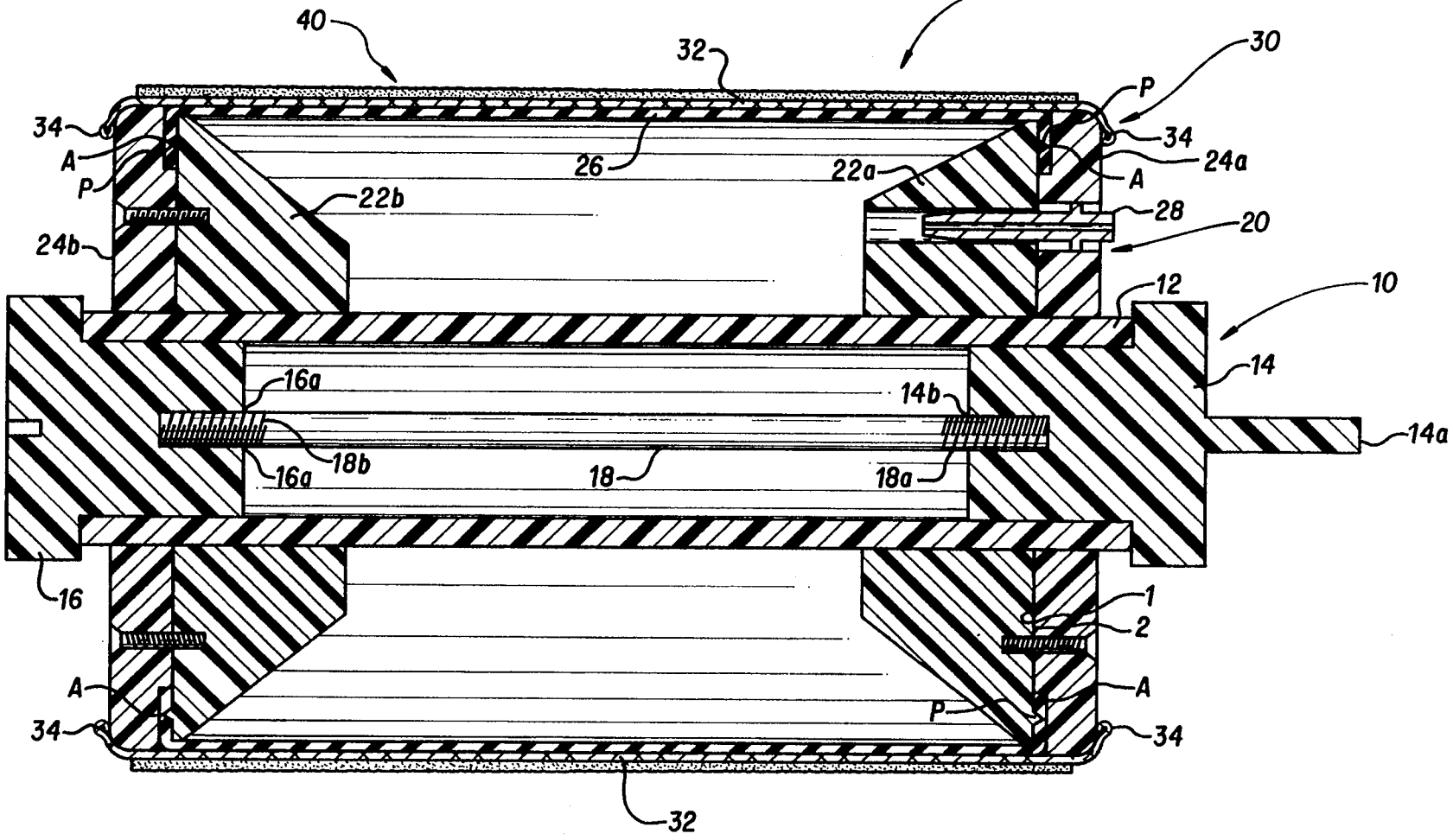
FIG. 1 shows a cross-sectional view of an inflatable sanding drum according to the present invention.
Figure 2:
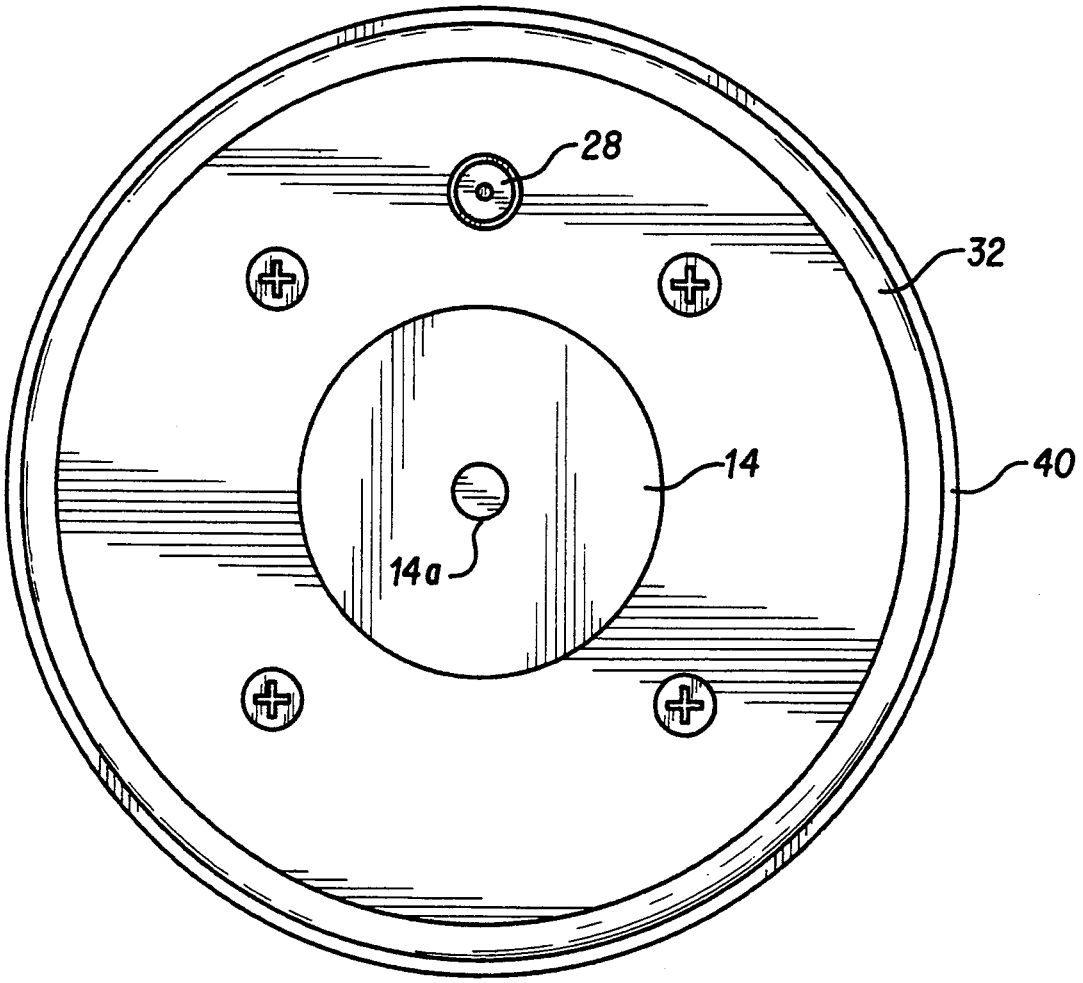
FIG. 2 shows a front view of the inflatable sanding drum shown in FIG. 1 viewed from a direction X.

Referring now to FIGS. 1 and 2, a description will now be given of an inflatable sanding drum 1 according to the present invention. The inflatable sanding drum 1 is connectable to a drill or lathe (not shown) via a chuck or threadable attachment (not shown), and facilitates in abrading a wood surface. The inflatable sanding drum 1 comprises a connection member 10, an air-chamber forming member 20, a cover member 30, and an abrasive member 40. The air-chamber forming member 20 is provided around the connection member 10. The cover member 30 is provided around the air-chamber forming member 20. The abrasive member 40 is provided around the cover member 30.

The connection member 10 is connectable to the drill or lathe (not shown) via the chuck or threadable attachment (not shown). The connection member 10 comprises a pipe 12, a distal end portion 14, a proximal end portion 16, and a junction rod 18. The distal end portion 14 and the proximal end portion 16 are respectively partially inserted into the pipe 12 and secured to each other by the junction rod 18. The pipe 12 defines a rotational center of the inflatable sanding drum 1. The distal end portion 14 has a projecting member **14*a* extending from one end thereof and a threaded hole 14*b* in an opposite end of the same. The projecting member 14*a* is connectable to the drill (not shown) via the chuck (not shown). The threaded hole 14*b* is engaged with a threaded end 18*a* of the junction rod 18. The proximal end portion has a threaded hole 16*a* engagable with another threaded end 18*b* of the junction rod 18. When a rotational force is applied to the projecting member 14*a* of the distal end portion 14, the entire connection member 10** is rotated.

The air-chamber forming member 20 is inflatable to form an inflatable air chamber having predetermined air pressure around the pipe 12 of the connection member 10. The air-chamber forming member 20 comprises a pair of flanges **22*a* and 22*b*, a pair of end caps 24*a* and 24*b*, a rubber bladder 26, and a valve 28. Before the distal end portion 14 and the proximal end portion 16 are secured to the pipe 12, the flanges 22*a* and 22*b*, and the end caps 24*a* and 24*b* are secured to the pipe 12. As shown in FIG. 2, the end cap 24*a* is bolted on the flange 22*a* and the end cap 24*b* is bolted on the flange 22*b*. The flange 22*a* and the end cap 24*a* respectively have seal surfaces S1 and S2, and the flange 22*b*** and the end cap 24*b* respectively have sealing surfaces S3 and S4. The sealing surfaces S1 and S2 are joined to each other and the sealing surfaces S3 and S4 are joined to each other. The rubber bladder 26 is covered around the flange 22*a* and 22*b* and the pipe 12. There are apertures A between the flange 22*a* and the end cap 24*a*, and the flange 22*b* and the end cap 24*b*. The rubber bladder 26 is inserted into the apertures A and secured by the projection parts P of the flanges 22*a* and 22*b*. The rubber bladder 26 forms a chamber wall which defines the air chamber. The valve 28 perforates the flange 22*a* and end cap 24*a*. The air chamber is defined by the flanges 22*a* and 22*b* and the rubber bladder 26 and effectively made airtight. The air pressure in the air chamber is adjustable by air supply or release through the valve 28. Since the rubber bladder 26 is an elastic material, the air chamber is inflatable.

The cover member 30 protects the rubber bladder 26 (or the chamber wall). The cover member 30 comprises a canvas cover 32 and a pair of wires 34. The canvas cover 32 is slipped over the rubber bladder 26 and the end caps 24*a* and 24*b*. Each wires 34 is coupled about the perimeter of the ends of the canvas cover 32 so as to permit the canvas cover 32 to be secured about a corresponding one of end caps 24*a* and 24*b*. In this way, the cover member 30 provides a supplemental support for the rubber bladder 26.

The abrasive member 40 facilitates in abrading a wood surface. The abrasive member 40 comprises a sheet of sand paper, emery cloth or the like. The resiliency of the abrasive member 40 can be varied by adjusting air pressure of the air chamber formed by the air-chamber forming member 20. In other words, since the air chamber is inflatable, the resiliency of the abrasive member 40 is variable.

Next follows a description of an operation of the inflatable sanding drum 1. First, the connection member 10 is connected to a drill or the like (not shown)- The air pressure in the air chamber is desirably adjusted. When the drill rotates the connection member 10, the abrasive member 40 rotates so as to be permitted to sand a wood surface. As the abrasive member 40 is worn away, the wood surface may damages the canvas cover 32. If the canvas cover 32 is damaged, it may be replaced with a new canvas cover 32. Thus, the rubber bladder 26 and the air chamber are effectively protected from being damaged.

It is to be understood that the present invention is not limited to the sole embodiment described above, but encompasses any and all embodiments within the scope of the following claims.

What is claimed is:

1. A device for use with an abrasive member and an abrading machine so as to abrade a predetermined surface area, said device comprising:

a connection member connectable to the abrading machine so as to be rotated, said connection member includes:

a pipe having a first end and a second end, a distal end portion inserted into said first end of said pipe, said distal end portion connectable to the abrading machine, a proximal end portion inserted into said second end of said pipe, and a junction rod inserted into said pipe, said junction rod securing said distal end portion and said proximal end portion in said pipe, wherein said distal end portion and said proximal end portion each have thread holes, and said junction rod has two threaded ends each engagable with a respective one of said thread holes of said distal end portion and proximal end portion;

air-chamber forming means coupled to said connection member for forming an air chamber with a desired air pressure around said connection member, said air-chamber forming means comprising a chamber wall which defines said air chamber;

a cover member attached to said chamber wall of said air-chamber forming means so as to cover said chamber wall, wherein;

the abrasive member is attached to said cover member and is rotatable with said connection member so as to abrade the predetermined surface.

2. The device according to claim 1, wherein said air-chamber forming means further comprises:

a pair of flanges attached to said connection member;

a pair of end caps, secured to said flanges and attached to said connection member;

an elastic member, wound around said flanges, which forms said chamber wall and makes said air chamber inflatable; and a valve which supplies and removes air in said air chamber.

3. The device according to claim 2, wherein said pair of flanges and said pair of end caps define apertures therebetween when said pair of flanges are secured on said pair of end caps, and said elastic member is inserted into said apertures so as to make said air chamber airtight.

4. The device according to claim 3, wherein said pair of flanges each have projecting parts which secure said elastic member in said apertures.

5. The device according to claim 2, wherein said cover member comprises:

a canvas cover, slipped over said elastic member and said end caps, which protects said elastic member being damaged; and a pair of wires, coupled to said canvas cover, which secures said canvas cover to said end caps.

6. The device according to claim 1, wherein said abrasive member comprises sand paper.

7. The device according to claim 1, wherein said air-chamber forming means comprises a valve which supplies and releases air to and from said air chamber.

* * * * *